United States Patent [19]

Weaver

[11] Patent Number: 5,060,850

[45] Date of Patent: Oct. 29, 1991

[54] BAG-LIKE FOLDING CARTON

[75] Inventor: Sherry M. Weaver, Chicago, Ill.

[73] Assignee: Waldorf Corporation, St. Paul, Minn.

[21] Appl. No.: 622,714

[22] Filed: Dec. 5, 1990

[51] Int. Cl.[5] ..... B65D 5/06

[52] U.S. Cl. ..... 229/117.06; 229/117.14; 229/117.15

[58] Field of Search ..... 229/117.06, 117.15, 229/117.14; 383/10, 104, 120

[56] References Cited

U.S. PATENT DOCUMENTS

| | | | |
|---|---|---|---|
| 2,191,723 | 2/1940 | Mulnix | 229/117.15 |
| 3,199,760 | 8/1965 | Conescu . | |
| 3,682,372 | 8/1972 | Rodley | 383/120 |
| 3,743,172 | 7/1973 | Ackley et al. | 383/104 |
| 4,121,757 | 10/1978 | Hamlin . | |
| 4,243,171 | 1/1981 | Prin . | |
| 4,691,368 | 9/1987 | Roessiger | 383/10 |
| 4,848,930 | 7/1989 | Williams et al. | 383/104 |

*Primary Examiner*—Stephen Marcus
*Assistant Examiner*—C. McDonald
*Attorney, Agent, or Firm*—Dorsey & Whitney

[57] ABSTRACT

In accordance with the present invention, an improved bag-like foldable carton for carrying articles, particularly fast food and drink products, is provided. The carton comprises a pair of side panel groups, with a bottom panel group integrally formed with and extending between the side panel groups. The bottom panel group is joined to the side panel groups at a pair of opposed parallel bottom fold lines at opposite edges thereof and includes a main bottom panel and a pair of gusseted bottom closure panels.

The invention also encompasses a flat blank for forming into the carton and a straight-like gluing, partial erection manufacturing method for forming the carton into a configuration wherein it is easily erected at the point-of-use.

10 Claims, 6 Drawing Sheets

BAG-LIKE FOLDING CARTON

TECHNICAL FIELD

The present invention relates to folding cartons or receptacles for containing and carrying articles. More particularly, the present invention relates to a disposable or recyclable, bag-like folding carton that provides improved strength and durability, yet is easily erectable.

BACKGROUND ART

Folding paper bags or sacks have been used for a long time as a convenient way to contain, carry or sell items. Such bags are inexpensive, easy to store flat, easy to erect for use and easily disposable or recyclable. While these advantages are valuable and while paper containers have found wide acceptance in many consumer oriented businesses, one of the problems is that such containers are, by their nature, of limited strength and stiffness. This is true particularly when the items or products to be carried in the bag form condensation or emit steam, being either hot or cold, or tend to leak moisture, oil or grease, as is the case with certain food items. In these instances, the paper forming the bag is weakened; it loses stiffness and strength and the items in the bag may even fall through the bag. This can cause inconvenience and, at the worst, in the case of hot liquids or foods or glass containers, possible injury.

Many containers exist in the prior art. U.S. Pat. No. 1,671,050 discloses a method of making reinforced paper bags. Somewhat similarly, U.S. Pat. No. 2,761,609 discloses a collapsible container wherein a sheet-like, solid, one-piece bottom is united with a container body.

U.S. Pat. Nos. 681,472, 1,299,503 and 1,532,316 disclose other collapsible containers which may be flattened for storage or transportation and later erected for containing items. U.S. Pat. Nos. 2,354,369 and 2,354,370 disclose foldable carriers for bottles.

U.S. Pat. Nos. 3,199,760, 4,121,757 and 4,243,171 disclose cartons or carriers for packing and carrying articles wherein the containers include integral handles. In particular, U.S. Pat. No. 4,243,171 discloses a carrier in the form of a box made by folding and gluing a single blank of cardboard. The disclosed carrier includes a gripping means and side gussets.

Although the commercially available cartons and the cartons disclosed in the prior art represent improvements, there are some problems which have remained unaddressed. One such problem relates to the economics of production and, specifically, to the need for a carton that minimizes the expenses of manufacturing and erection, yet can be shipped as a glued, flat carton to commercial users, such as fast food restaurants. While cartons such as the container structure disclosed in U.S. Pat. No. 2,761,609 may be flattened for shipping and storing, making such a container can be relatively expensive, because it requires the joining of a separate bottom to the carton body. Likewise, the collapsible box disclosed in U.S. Pat. No. 715,026 requires the attachment of separate side sections.

Another disadvantage found in some folding containers disclosed in the prior art is that they do not provide for container or carton bottoms that are closed. They will therefore be unsuitable for holding popcorn, french fries, nuts or other food items of similar size. For example, the paper box disclosed in U.S. Pat. No. 405,413 is collapsible, but after erection it has an opening at the sides near the bottom of the erected box. The same limitation is apparent in the carriers of U.S. Pat. Nos. 2,345,369 and 2,354,370 (although it would not be a disadvantage as long as these are used solely to hold bottles).

An important problem not adequately addressed by the prior art is that complex gluing and folding processes for forming collapsible cartons can make some designs very expensive to produce. For example, the manufacturing process for the structure shown in U.S. Pat. No. 4,121,757 involves the application of adhesive to many flap surfaces oriented in diverse directions. To form the collapsible box disclosed in U.S. Pat. No. 715,026, a blank including two sides and a bottom must be formed and brought together with and glued to two separate side sections or panels. If adhesive is misapplied in complex forming operations, the panels forming such cartons may fail to connect or align properly and the carton may be weak, malformed and unusable. Moreover, the more complex the folding and gluing operations required to form a carton, the more complex the manufacturing equipment required. Manufacturing complexity usually slows production rates as well.

In summary, despite the many prior art designs, there remains a need for a bag-like foldable container that can be manufactured with a simple, inexpensive, folding, erection and gluing sequence. Additionally, it is desirable to produce a bag-like folding carton of a material stronger than ordinary paper, yet supple and resilient enough to be easily, foldably collapsed and erected along fold score lines. Finally, it is desirable to design a collapsible container having the preceding characteristics that also has integral gussets or panels that make a closed container bottom when the carton is erected.

Simply put, current bag-like foldable containers do not achieve efficient manufacture or the desired degree of performance and strength. Accordingly, there is a need for a foldable, strong, cost efficient, disposable or recyclable paperboard package with an integral closed bottom for containing and carrying articles.

SUMMARY OF THE INVENTION

In accordance with the present invention, an improved bag-like foldable carton for carrying articles, particularly fast food and drink products, is provided. The carton comprises a pair of opposed side panel groups, each including a main panel with opposed end panels. A bottom panel group is integrally formed with and extends between the two side panel groups. The bottom panel group is joined to the side panel groups at a pair of opposed parallel bottom fold lines at opposite edges thereof and includes a generally central main bottom panel and a pair of gusseted bottom closure panels.

The invention also encompasses a flat blank for forming into the carton and a straight-line gluing and partial erection manufacturing method for forming the carton into a configuration wherein it is easily erected to its completed state at the point-of-use.

An objective of the present invention is to provide a bag-like carton for carrying items for which the cost/benefit ratio of carton manufacture is improved.

Another objective of the present invention is to provide a carton for commercial users wherein the carton is sold to the commercial users in a partially erected, glued form, yet in a collapsed, generally flat condition, whereby the commercial user efficiently and quickly can complete the erection of the carton for containing items for consumers.

A further objective is to produce a bag-like foldable carton that has a closed gusseted bottom structure when erected.

An important advantage of the present invention is that it combines cost efficient manufacturing and storage with point-of-use efficiency and enhanced durability for use by the end consumers.

Other advantages of the present invention are that it reduces consumption of valuable package-making resources such as paperboard. It provides for more efficient, cost effective die-cutting of the blank for the carton, as well as more efficient, cost effective gluing, partial erection and shipping of the carton. The improved bag-like foldable carton of the present invention also provides for an automatically closing, closed carton bottom. Additionally, the foldable carton of the present invention easily may be produced in different sizes and is easily adapted for carrying printed information.

Other objects and advantages of the present invention will become more fully apparent and understood with reference to the following specification and to the appended drawings and claims.

DETAILED DESCRIPTION OF THE PREFERRED EMBODIMENT

Figure 1:
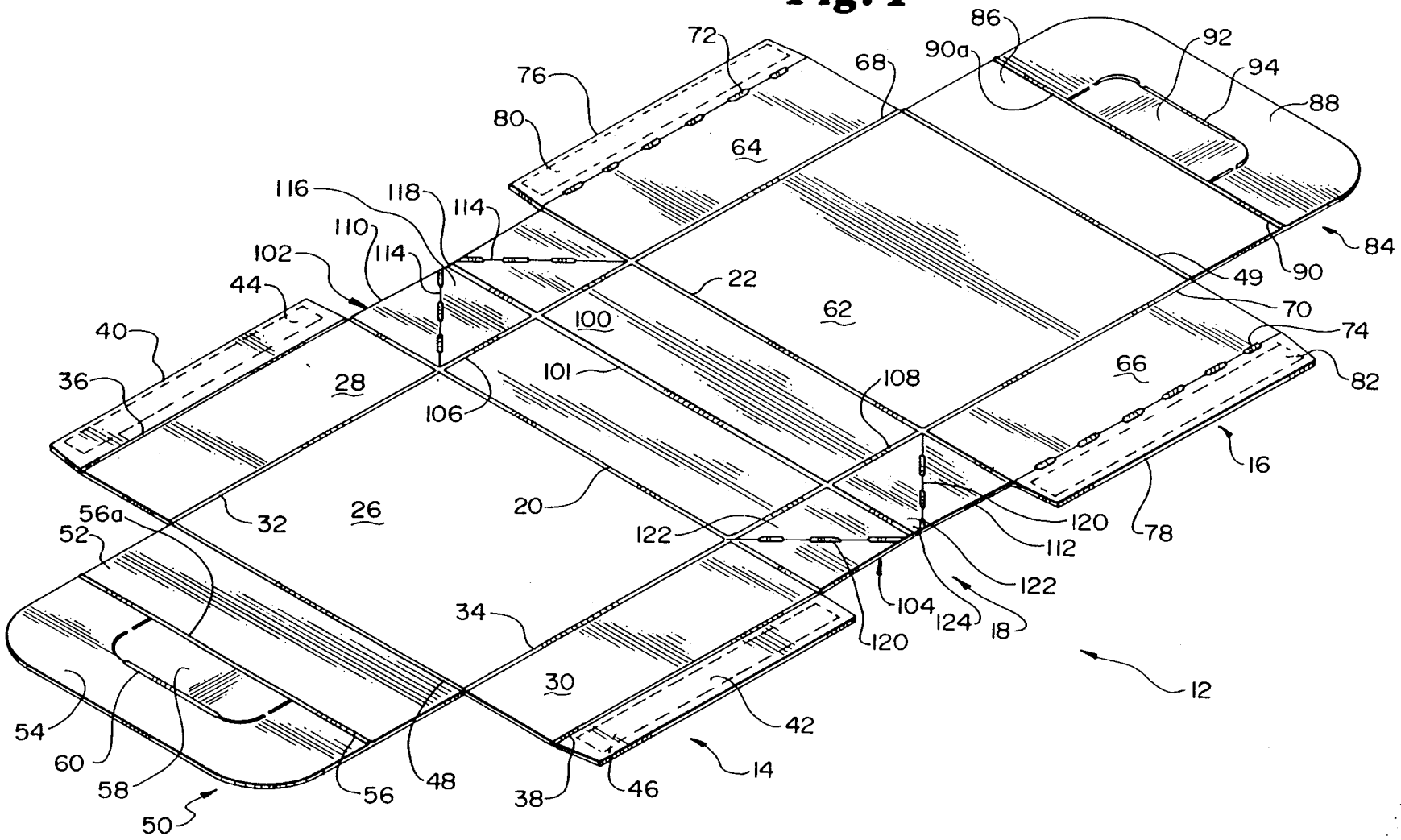
FIG. 1 is a perspective view of the inside of the blank from which the carton of the present invention may be formed and shows the die-cut profile thereof.

As depicted in FIG. 1, the bag-like folding carton 10 (see FIGS. 6–8) of the present invention is formed from a flat blank 12. The blank 12 includes a first side panel group 14, a second side panel group 16 and a bottom panel group 18. Panel groups 14, 16 and 18 are integrally formed and the side panel groups 14, 16 are foldably connected to the bottom panel group 18 at spaced, parallel fold score lines 20, 22, respectively. The blank 12 preferably is made from a flexible, resilient material such as paperboard. Because it is desired to produce a carton that is bag-like yet has some stiffness, paperboard having a caliper of 0.006 to 0.040, preferably about 0.012 to 0.014 is used.

The first side panel group 14 includes a large, generally rectangular first main panel 26. A pair of opposed end panels 28, 30 is connected to the main panel 26 at side panel fold lines 32, 34, respectively. The fold lines 32, 34 are parallel and generally perpendicular to the bottom fold lines 20, 22. Each end panel 28, 30 is generally rectangular and, opposite the side panel fold line 32, 34 has an optional glue score line 36, 38, respectively. The glue score lines 36, 38 define a pair of glue panels 40, 42, respectively, foldably connected to the end panels 28, 30, respectively. Each glue panel 40, 42 includes an adhesive or glue area 44, 46.

At the left outermost edge of the first side panel group 14 (as seen in FIG. 1) a handle fold line 48 connects a first handle forming group 50 to the first side panel group 14. The handle forming group 50 includes a top closure panel 52 and a grip panel 54. The grip panel 54 is foldably connected to the top closure panel 52 at a grip panel fold line 56. A hinged finger tab 58 is defined in the grip panel 54 by a U-shaped tab cut line 60. The legs of the U-shaped tab cut line 60 meet the grip panel fold line 56 and define a segment 56*a* of fold line 56 that is through-cut. The opposed, straight portion of U-shaped top cut line 60 is scored rather than cut to form a hinge for finger tab 58. The legs of the U-shaped tab cut line 60 are cut to allow hinging along the scored portion of tab cut line 60.

The second side panel group 16 is substantially a mirror image of the first side panel group 14 and includes a generally rectangular central main panel 62. A pair of end panels 64, 66 is foldably connected to the main panel 62 at parallel, opposed side panel fold lines 68, 70, respectively. Each end panel 64, 66 includes a glue score line 72, 74, respectively, spaced from and opposite the corresponding adjacent side panel fold line 68, 70. Each respective glue score lines 72, 74 defines a glue panel 76, 78 foldably attached to its respective end panel 64, 66 at one of the glue score lines 72, 74. Each glue panel 76, 78 includes a glue area 80, 82, respectively.

At the extreme right end of the main panel 62 (as seen in FIG. 1), the second side panel group 16 includes a second handle forming group 84 connected at handle fold line 49 to the second side panel group 16. The handle forming group 84 includes a top closure panel 86 and a grip panel 88. The grip panel 88 is foldably connected to the top closure panel 86 along a grip panel fold line 90. A finger tab 92 is formed and defined in grip panel 88 by a U-shaped tab cut line 94. A segment 90*a* of the grip panel fold line is through-cut to allow hinging of the finger tab 92 along the straight portion of the U-shaped tab cut line, as in the first handle forming group 50.

With continued reference to FIG. 1, the bottom panel group 18 includes a generally central main bottom panel 100. The main bottom panel 100 is generally rectangular and is connected to the first main panel group 14 at the bottom fold line 20 and to the second main panel group 16 at the opposed, parallel bottom fold line 22. At each of the opposed ends of the main bottom panel 100, one of a pair of gusseted bottom closure panels 102, 104 is foldably connected to the bottom panel 100 at a fold line 106, 108, respectively. In the blank shown in FIG. 1, the fold line 106 connects the collinear side fold line pair 32, 68, while the fold line 108 connects the collinear side fold line pair 34, 70. A bottom center score line 101 bisects the main panel 100 and extends across fold lines 106, 108 and panels 102, 104 to the outermost free edges 110, 112, respectively, of the bottom closure panels 102, 104.

The bottom closure panel 102 is provided with angled gusset fold lines 114. The fold lines 114 are formed by interrupted linear incisions that extend roughly from the intersection of the center score line 101 and the outermost free edge 110, to the intersection of the closure panel fold line 106 and the bottom fold line 22 on one side and the bottom fold line 20 on the opposite side of the bottom closure panel 102. The closure panel fold line 106 and the generally V-shaped pair of gusset fold lines 114, together define a triangularly shaped area 116 having an apex 118 located generally at the outermost free edge 110 of the bottom closure panel 102.

Similarly, bottom closure panel 104 is provided with an angled gusset fold lines 120. The fold lines 120 are also formed by a series of interrupted, linear incisions and extend from the intersection of the center score line 101 and the outermost free edge 112 of closure panel 104 to the ends of fold line 108. The gusset fold lines 120 meet the intersection of fold line 108 and fold line 22 on one side and meet the intersection of fold line 108 and fold line 20 on the other side, forming triangular area 122 having an apex 124 located generally at the outermost free edge 112 and a base along the fold line 108.

Figure 5:
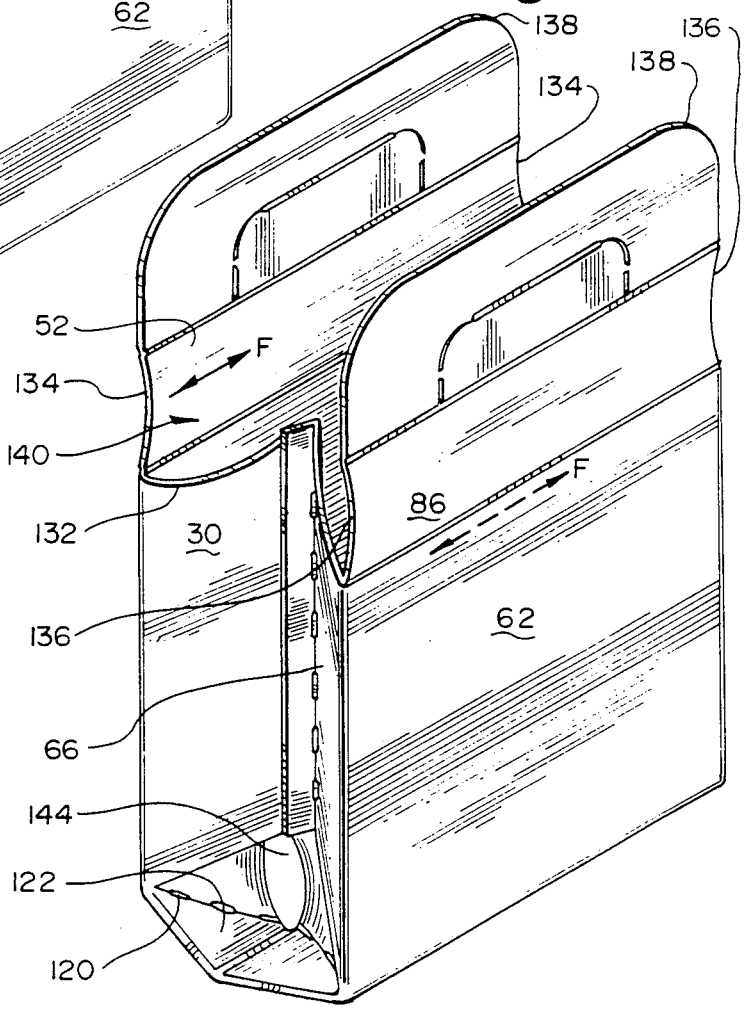
FIG. 5 is a perspective view of a second embodiment of the carton of the present invention, partially erected in the same manner as the embodiment of FIG. 4.
Figure 7:
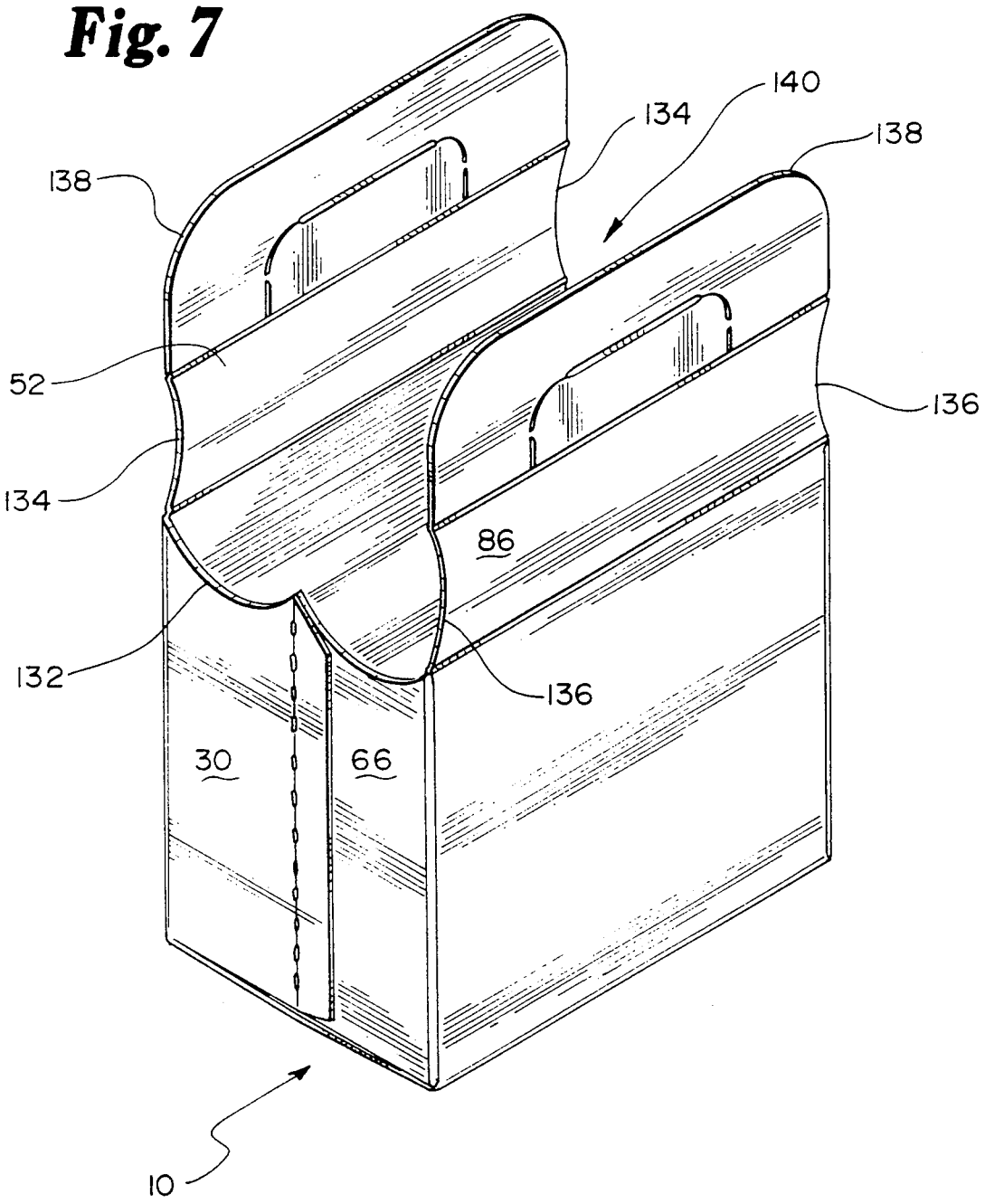
FIG. 7 is a perspective view of the second embodiment of the present invention fully erected.

FIGS. 5 and 7 depict a second embodiment of the carton 10 of the present invention. The blank from which the second embodiment is formed is substantially similar to the blank 12 for the first or preferred embodiment with the following noted exceptions:

(a) Only one of the first and second side panel groups 14, 16 has end flaps that include glue panels. In the other panel group the end flaps are narrower because the glue panels are not present.

(b) The free edge of each end panel 28, 30, 64, 66 that is aligned with fold line 48 or 49 is cut in a concave curve 132. Similarly, the adjacent free edges of each top closure panel 52, 86 are edged by concave curves or any decorative edge 136, respectively.

(c) The one side panel group that has glue panels has these defined by score lines that permit the glue panels to be back-folded onto the adjacent end panel before gluing. (That is, taking side panel group 16 in FIG. 2 as the group having glue panels 40, 42, these panels 40, 42 are back-folded outwardly onto end panels 28, 30, respectively, after the end panels 28, 30 are folded inwardly onto main panel 26.)

Additionally, although not depicted, the grip panels 54, 88 may have edges 138 formed in any desired configuration, such as straight angular edges, rather than the depicted curved edges 138.

Figure 2:
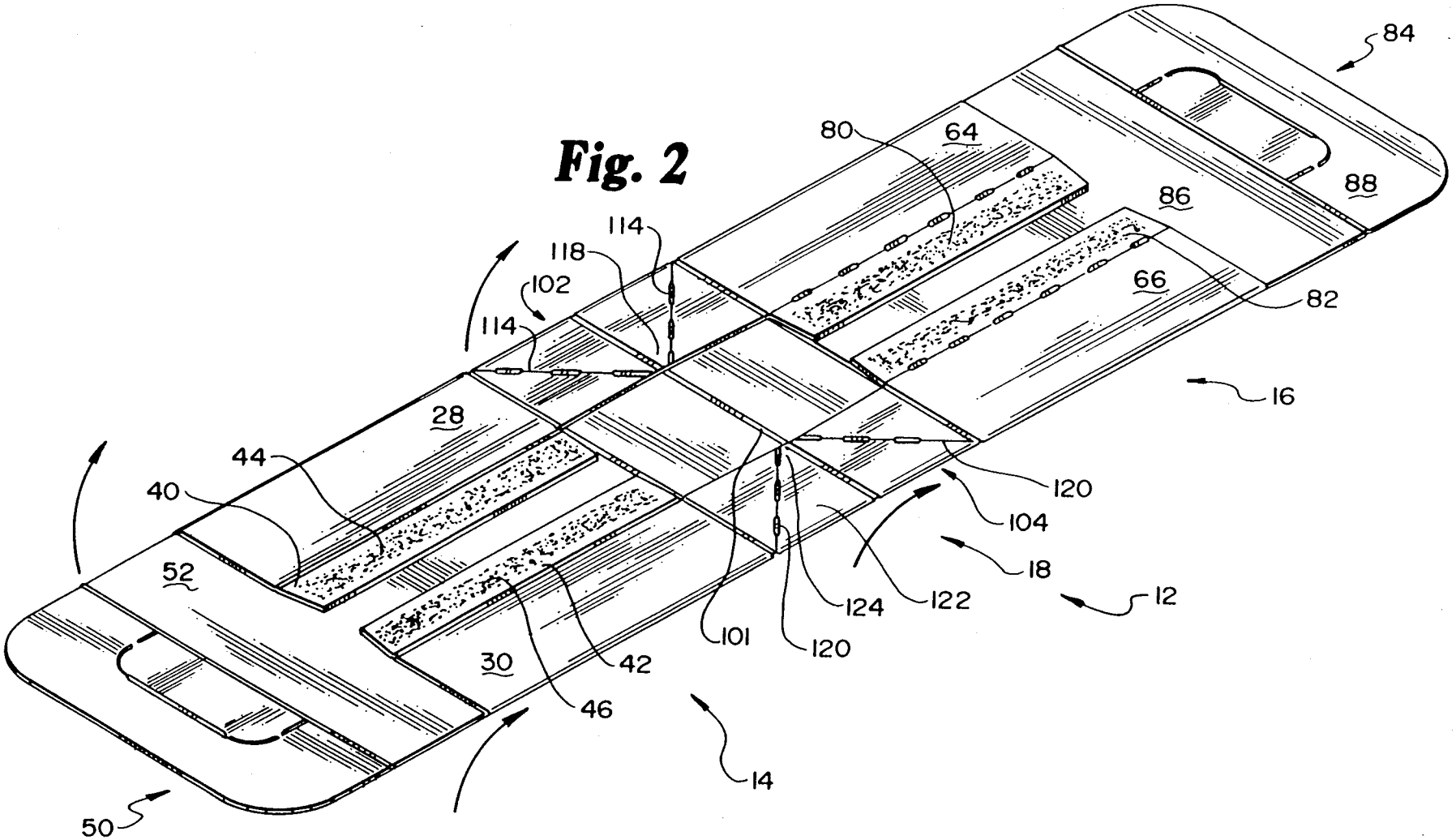
FIG. 2 is a perspective view of the blank of the present invention depicting an intermediate step in the carton erection sequence.
Figure 6:
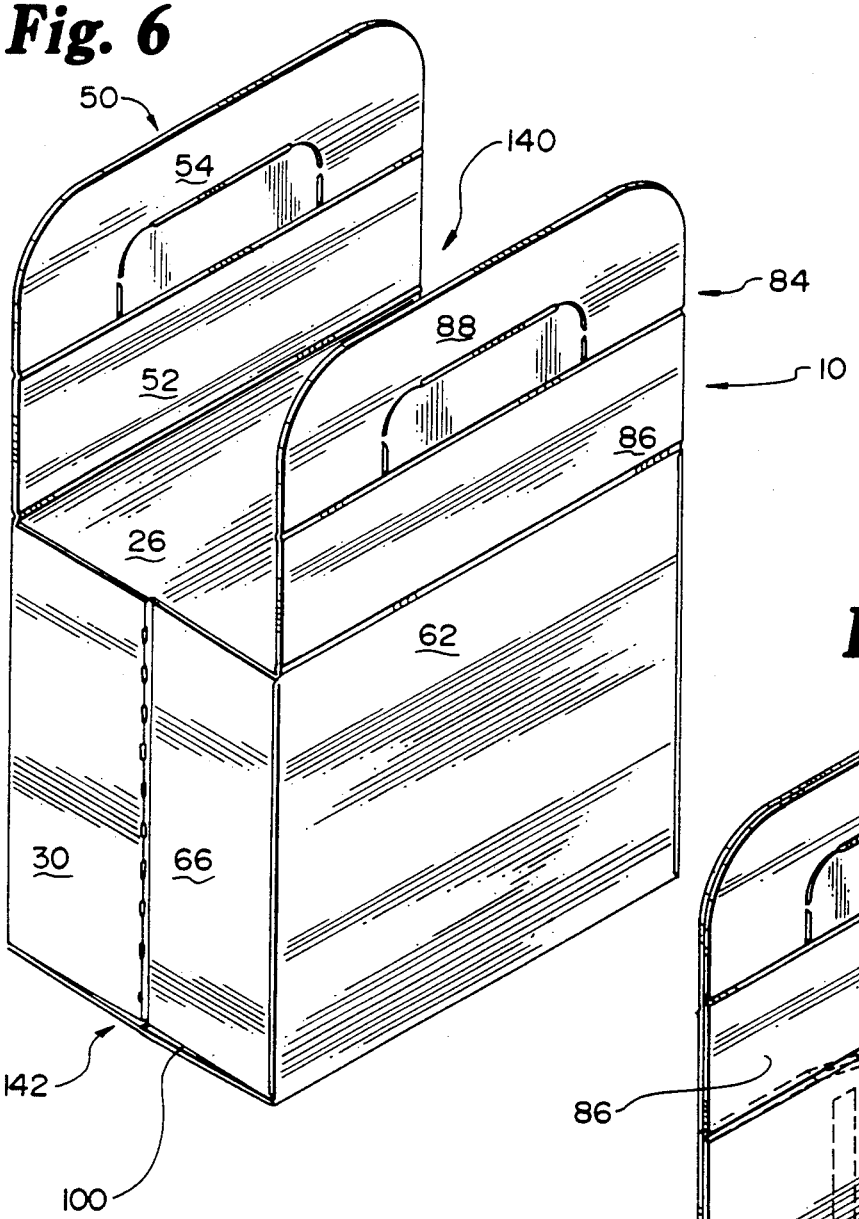
FIG. 6 is a perspective view of the preferred embodiment of the present invention fully erected and ready for filling.

To form the carton 10 of the present invention, depicted (in the preferred embodiment) fully erected in FIG. 6, a simple folding and gluing sequence is used. As depicted in FIG. 2, the end panels 30, 66 and bottom closure panel 104 are all folded inwardly (along fold lines 34, 108, 70) toward the plane of the blank and, specifically, toward the inside of the main panels 26, 62 and main bottom panel 100 until they lie flat on these panels. Likewise, end panels 28, 64 and bottom closure panel 102 are folded inwardly along fold lines 32, 106, 68 until they overlie the other side of the main panels 36, 62 and main bottom panel 100.

Glue may then be applied along each of or selected pairs of the glue areas 44, 46 and 80, 82. In FIG. 2, the glue is applied to the areas 80, 82 in two parallel straight lines after the first folds described in the preceding paragraph have been made. Any suitable adhesive or glue may be used, so long as it is compatible with the material from which the carton 10 is formed.

Figure 3:
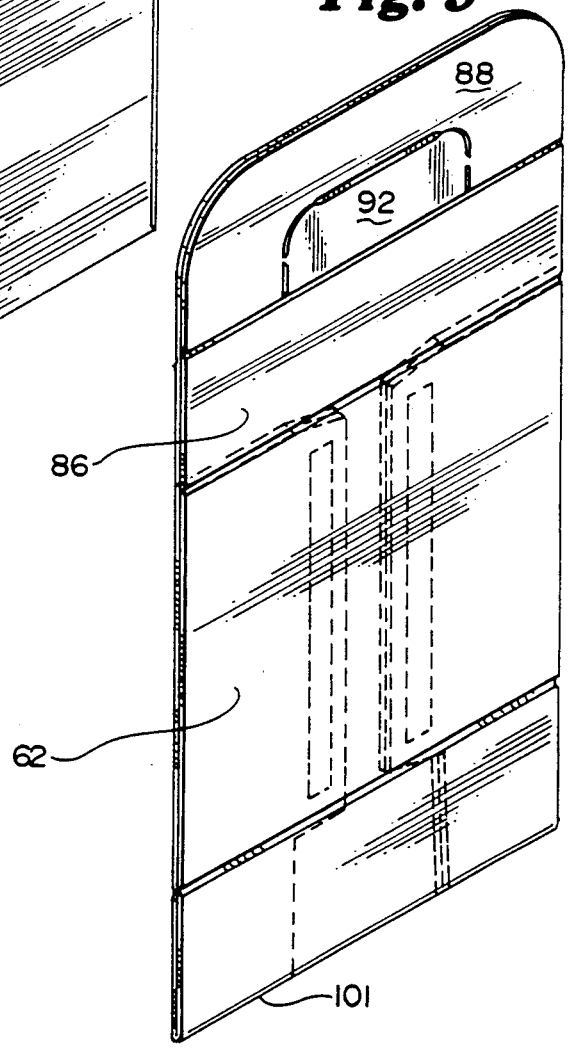
FIG. 3 is a perspective view depicting another intermediate step in the carton erection sequence.
Figure 4:
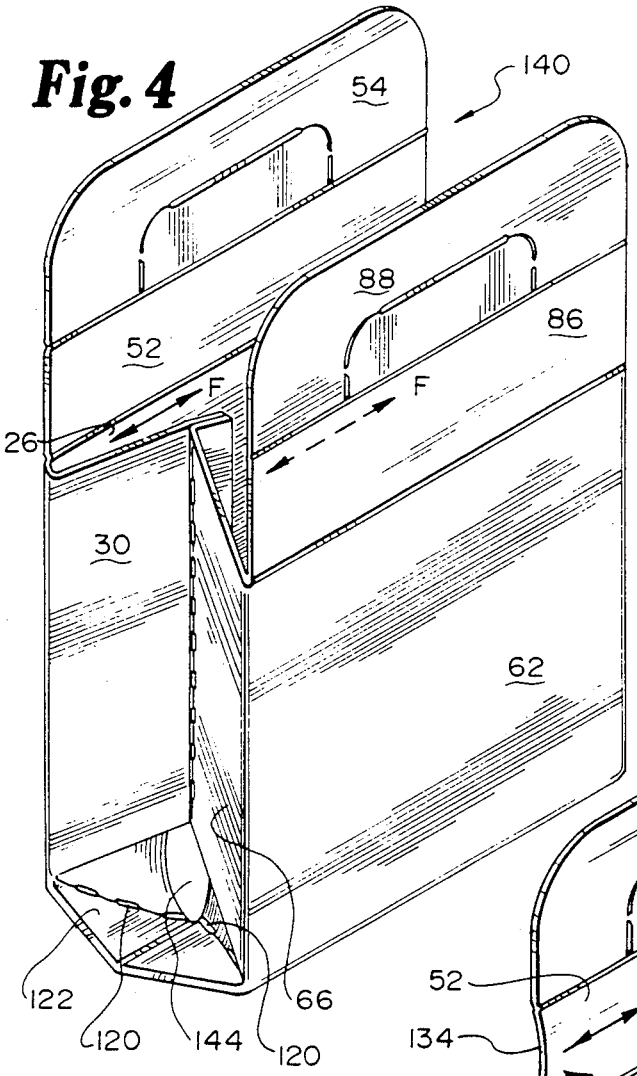
FIG. 4 is a perspective view of the present invention depicting the carton bottom partially erected.

After the glue has been applied, the blank is folded in half along the bottom center score line 101 to form the configuration depicted in FIG. 3, whereby the glue areas on panels 40 and 42 meet the glue panels 76, 78. Once the fold has been made along line 101, the carton 10 is in flattened condition (FIG. 3) for shipment to commercial users such as fast food restaurants.

Figure 8:
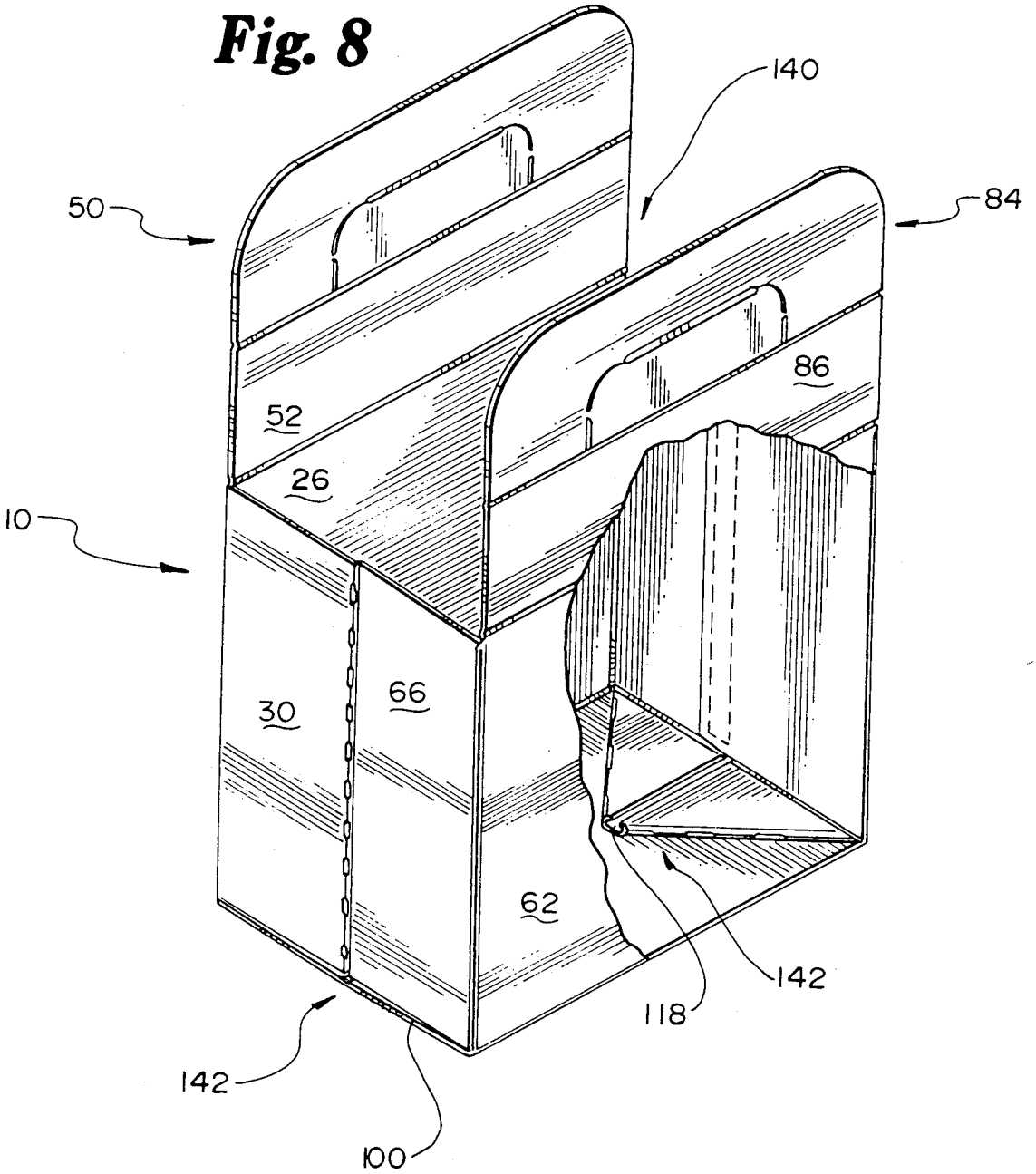
FIG. 8 is a perspective view of the preferred embodiment with portions cut away to reveal the bottom closing web formed by the gusseted bottom closure panels.

For erecting the carton 10 at the point of use or distribution to the end consumer, a person's hands, an indexing device or other suitable means of opening may be introduced into the carton interior 140 defined by the panel groups 14, 16 and 18 as depicted in FIGS. 4 through 8. An outwardly directed force (shown as arrows F in FIGS. 4 and 5) is exerted on the joined end panels 30, 66 and 28, 64, thereby expanding the main panels 26 and 62 away from one another. At this intermediate point in the erection sequence, the carton takes on the configuration depicted in FIGS. 4 or 5. As the carton is being erected, folds are formed at the angled gusset fold lines 114, 120, causing the triangular areas 116, 122 to fold upon themselves to form a pointed, gusseted double layer 142 automatically closing the space 144 between the main bottom panel 100 and the side walls 14, 16 of the carton 10. FIG. 8 best shows how the gusset closure is completed, with the gusseted double layer 142 lying flat against the main bottom panel 100.

It should be appreciated that the two parallel, straight-line glue paths and the erection sequence just described, wherein the apexes 118, 124 of the triangular areas 116 and 122 point inwardly and lie on the bottom panel 100 of the carton 10, substantially closes the bottom of carton 10, although no adhesive is applied to the bottom panel group 18. However, it is not beyond the scope of the present invention that adhesive or other fastening means be used to further secure the bottom panel group 18.

After the carton has been filled (not shown), the first and second handle forming groups 50, 84 may be brought toward one another across the open upper end 140 of the carton 10, thereby substantially closing the upper open end 148. Finger tabs 58, 92 may be folded inward to improve handle comfort, and the carton 10 may be conveniently carried thereby.

Important commercial advantages of the present invention include that the carton 10 may be glued and erected with substantially less mechanical tolerance and supervision than is required for manufacturing many prior art cartons. Additionally, at the point of use, the erection of the carton 10 to the configuration depicted in FIG. 6 is easily accomplished. The bottom of the carton 10 will be automatically closed by the double layer 142 formed by gusseted bottom closure panels 102, 104. The material from which the preferred embodiment of the carton 10 is fabricated, paperboard, provides a stiffness and resiliency which further helps keep the carton bottom in closed condition. Another important advantage of the present invention is that even if the bottom panel group 18 or side panel groups 14, 16 are distorted by a person using the carton 10 or by the weight carried therein, product carried in the carton interior 140 cannot escape easily because of the closing structure 142 provided by the gusseted bottom closure panels 102, 104. The panels 102, 104 also serve to strengthen the carton 10. A number of variations of the present invention can be made. For example, the carton 10 may be made in various sizes, and the paperboard or other material from which the present invention is fabricated may be of any suitable composition and coated to provide desirable characteristics, such as resistance to liquids. Indicia, including instructions or advertising may be printed on the blank 12 or flattened carton 10. The handle portion of the carton may be provided with a locking means to hold the handle groups 50, 84 together.

Although the description of the preferred embodiment has been presented, it is contemplated that various changes, included those mentioned above, could be made without deviating from the spirit of the present invention. It is therefore desired that the present embodiment be considered in all respects as illustrative, not restrictive, and that reference be made to the appended claims rather than the foregoing description to indicate scope of the invention.

What is claimed is:

1. A blank for a container comprising:

a first side panel group comprising:

a generally rectangular first main panel; and a pair of opposed end panels, each said end panel being generally rectangular and joined to said first main panel at a side panel fold line, said side panel fold lines being parallel and at opposite edges of said first main panel, each of said end panels further having at the outer margin thereof a glue panel defined by a glue score line lying parallel to the side panel fold line associated with said end panel;

a second side panel group comprising:

a generally rectangular second main panel; and a pair of opposed end panels, each said end panel being generally rectangular and joined to said second main panel at a side panel fold line, said side panel fold lines being parallel and at opposite sides of said second main panel and each said side panel fold line being substantially collinear with one of the side panel fold lines of said first side panel group to form a pair of substantially collinear side panel fold lines; and a bottom panel group integrally formed with and extending between said first and second side panel groups, said bottom panel group being joined to the first and second side panel groups at a pair of parallel bottom fold lines, each said bottom fold line being at an opposite edge of said bottom panel group and being substantially perpendicular to the collinear side panel fold lines of the first and second side panel groups, said bottom panel group comprising:

a generally rectangular main bottom panel;

a pair of gusseted bottom closure panels, each said closure panel being generally rectangular and joined to said main bottom panel at a closure panel fold line, said closure panel fold lines being parallel and each said closure panel fold line extending between one pair of the collinear side panel fold lines of the first and second side panel groups, each said closure panel having an outermost free edge lying substantially parallel to its closure panel fold line;

a bottom center score line lying parallel to and between the pair of parallel bottom fold lines, said bottom center score line extending substantially between the outermost free edges of the closure panels; and a pair of gusset fold lines associated with each closure panel, each gusset fold line extending substantially from the point where the bottom center score line intersects the outermost free edge of the associated closure panel to one of the two points at which the closure panel fold line of said associated closure panel intersects the parallel bottom fold lines.

2. The blank according to claim 1, wherein each end panel of the second side panel group has at its outer margin a glue panel defined by a glue score line lying parallel to the side panel fold line associated with said end panel.

3. The blank according to claim 1, wherein each of said side panel groups has a handle means for forming a handle, each said handle means foldably joined to one of said side panel groups.

4. The blank according to claim 1, wherein each pair of gusset fold lines extends in a V-shape substantially from the point where the bottom center score line intersects the free edge of the associated closure panel.

5. The blank according to claim 4, wherein said pair of gusset fold lines associated with each closure panel defines a generally triangular gusset structure thereon.

6. The blank according to claim 1, wherein each pair of said gusset fold lines forms a generally triangular gusset structure, each said gusset structure being foldably connected to said main bottom panel along said closure panel fold line.

7. A bag-like folding carton adapted for erecting from a collapsed configuration comprising:

a single piece blank of paperboard having a length, said blank having a pair of parallel fold lines extending transversely across said length and formed to consecutively define a first side panel group, a bottom panel group and a second side panel group;

said bottom panel group extending between said first and second side panel groups and being connected substantially at right angles to each of said first and second side panel groups along said two parallel transverse fold lines, said bottom panel group further including a main bottom panel having four edges, two of said edges defined by said two parallel transverse fold lines and the other two edges defined by a pair of parallel closure panel fold lines, each said closure panel fold line being oriented substantially perpendicular to said two parallel transverse fold lines and foldably connecting one of a pair of gusseted closure panels to said main bottom panel, each of said gusseted closure panels also being foldably connected between said first and second side panel groups along said two parallel transverse fold lines and each having an outermost free edge parallel to said closure panel fold lines, a portion of each of said gusseted closure panels overlying said main bottom panel;

each of said side first and second panel groups including a central main panel foldably connected to said bottom main panel along said two parallel transverse fold lines and a pair of end panels, each end panel of each pair being connected to its respective central main panel along one of a pair of parallel side panel fold line and being connected to one of said gusseted closure panels along said two parallel transverse fold lines, said side panel fold lines being substantially coplanar with and oriented generally perpendicular to said closure panel fold lines; and at least one of said first and second side panel groups further including a pair of glue panels, each glue panel being foldably connected to one of the end panels of said at least one side panel group along a glue score line spaced from and parallel to the adjacent side panel fold line, said pair of glue panels of said at least one side panel group being adhered to the other side panel group.

8. The carton according to claim 7, wherein said bottom panel group includes a center fold line bisecting said main bottom panel and oriented parallel to said transverse fold lines, said center fold line extending between said outermost free edges.

9. The carton according to claim 8, wherein each of said pair of gusseted closure panels includes a pair of gusset fold lines, each gusset fold line extending substantially from the point where said center fold line intersects said outermost free edge of the associated closure panel to one of the two points where said closure panel fold lines intersect said two parallel transverse fold lines.

10. The carton according to claim 7, wherein said pair of gusseted closure panels forms a carton bottom closing web extending between said side panel groups and main bottom panel when said carton is erected.

* * * * *